US008608102B2

(12) United States Patent
Brennaman

(10) Patent No.: US 8,608,102 B2
(45) Date of Patent: Dec. 17, 2013

(54) MODULAR REEL STRUCTURE

(75) Inventor: Gary E. Brennaman, Hartselle, AL (US)

(73) Assignee: Sonoco Development, Inc., Hartsville, SC (US)

( * ) Notice: Subject to any disclaimer, the term of this patent is extended or adjusted under 35 U.S.C. 154(b) by 366 days.

(21) Appl. No.: 12/906,536

(22) Filed: Oct. 18, 2010

(65) Prior Publication Data

US 2011/0101153 A1 May 5, 2011

Related U.S. Application Data

(60) Provisional application No. 61/256,008, filed on Oct. 29, 2009.

(51) Int. Cl.
*B65H 75/14* (2006.01)
*B65H 75/22* (2006.01)

(52) U.S. Cl.
USPC ..... 242/608; 242/609

(58) Field of Classification Search
USPC ..... 242/600, 607, 608–608.8, 609
See application file for complete search history.

(56) References Cited

U.S. PATENT DOCUMENTS

| | | | |
|---|---|---|---|
| 1,642,106 | A | 9/1927 | Fairbank |
| 1,905,488 | A | 4/1933 | Nack |
| 1,972,572 | A | 9/1934 | Nack |
| 2,503,374 | A | 4/1950 | Bureau |
| 2,928,623 | A | 3/1960 | Mayhew |
| 3,284,021 | A | 11/1966 | Ryll et al. |
| 3,297,154 | A | 1/1967 | Lyman |
| 3,565,363 | A | 2/1971 | Mizuguchi et al. |
| 3,704,838 | A | 12/1972 | Bernier et al. |
| 3,827,651 | A | 8/1974 | Benson et al. |
| 3,940,085 | A | 2/1976 | Campbell |
| 4,895,316 | A | 1/1990 | Salloum |
| 5,004,179 | A | 4/1991 | Salloum |
| 5,169,086 | A | 12/1992 | Vesely |
| 5,242,129 | A | 9/1993 | Bailey et al. |
| 5,417,384 | A | 5/1995 | Lindstrand |
| 5,575,437 | A | 11/1996 | Campbell |

(Continued)

FOREIGN PATENT DOCUMENTS

| | | |
|---|---|---|
| DE | 199 12 366 A1 | 9/2000 |
| EP | 0 567 435 A1 | 10/1993 |
| JP | 2001 158571 | 6/2001 |

OTHER PUBLICATIONS

Machine translation of DE 199 12 366 A 1.*

(Continued)

*Primary Examiner* — William E Dondero
(74) *Attorney, Agent, or Firm* — Flaster/Greenberg, P.C.

(57) ABSTRACT

A reel assembly is provided comprising a cylindrical barrel, a barrel head secured to each end of the barrel and a flange construction secured to each barrel head adjacent the ends of the barrel. The flange construction is formed by arcuate flange segments, each releasably secured to one another and to the associated barrel head. The barrel head includes inner and outer annular supports and an end plate securing the structure together. The inner and outer annular supports define a receipt slot for receiving and securing an end of the barrel therein. The end plate is rigidly fixed to the inner and outer supports and the flange construction is releasably secured to the outer annular support of the barrel head.

17 Claims, 10 Drawing Sheets

(56) References Cited

U.S. PATENT DOCUMENTS

| | | | | |
|---|---|---|---|---|
| 5,605,305 | A | 2/1997 | Picton | |
| 5,718,397 | A | 2/1998 | Stevens | |
| 5,806,788 | A | 9/1998 | Witwer et al. | |
| 5,971,317 | A | 10/1999 | Jaros | |
| 6,179,245 | B1 | 1/2001 | Ripplinger | |
| 6,352,216 | B1 | 3/2002 | Coats | |
| 6,375,116 | B1 * | 4/2002 | Askins et al. | 242/609 |
| 6,398,154 | B1 | 6/2002 | Cox et al. | |
| 2008/0061187 | A1 | 3/2008 | Couchey et al. | |
| 2008/0245920 | A1 | 10/2008 | Houen | |

OTHER PUBLICATIONS

Search Report and Written Opinion; PCT/US2010/053025 (Feb. 15, 2011).

* cited by examiner

MODULAR REEL STRUCTURE

RELATED APPLICATIONS

The present invention relates to and claims the benefit of the filing date of U.S. Provisional Application Ser. No. 61/256,008, filed Oct. 29, 2009.

FIELD OF THE INVENTION

The present invention relates to a reel assembly for shipping wire, cable and the like. More particularly, the present invention relates to a knockdown reel assembly which may be assembled and disassembled as desired for shipment in both the loaded and unloaded condition.

BACKGROUND OF THE INVENTION

It is conventional to ship wire or cable wound on reels. After unwinding the wire or cable from the reel, the reel is typically returned or disposed of. The basic structure of the assembled reels includes a cylindrical barrel about which the wire or cable is wound and a pair of end flanges extending transversely from the ends of the barrel to retain the wound wire or cable on the barrel. The reels are mounted for rotation about an axis extending to the center of the cylindrical barrel and the end flanges, so that the wire or cable unwinds from the reel assembly as the reel is rotated. Examples of a modular reel construction are shown in U.S. Pat. No. 1,905,488 and U.S. Pat. No. 1,972,572 both to Nack. The reel construction of the Nack patents includes a barrel assembly with separately attachable flange sections, which are bolted to the surface of the barrel. Each flange is formed from a series of sections bolted together along radially extending struts. The ends of the barrel are closed by an annular ring having a recessed wall. Reinforcement barbs may be attached across the rim and support the barrel wall and the assembled flange portions.

Another knockdown reel construction is shown in U.S. Pat. No. 5,242,129 to Bailey. The reel construction of Bailey includes a flange assembly formed by a series of segments that are inserted into sockets formed on the ends of the barrel. The flange segments are joined to one another and a retaining ring is positioned within a groove on the end of the assembled flange segments.

A further knockdown reel assembly is shown in U.S. Pat. No. 6,352,216 to Coats. That reel has a barrel assembly with bolts projecting from the axial ends of the barrel. Flange segments are secured to the extending bolts for forming the flange construction.

A knockdown reel assembly is also shown in U.S. Pat. No. 5,806,788 to Witwer. Witwer's device includes a pair of separate barrel segments which are assembled to form a hollow cylindrical barrel. The barrel segments have an inwardly extending bead that locks separate end flange portions to opposite ends of the barrel. The end flanges have a two-piece construction that includes a hub secured to a skirt. The hub has a lip for engaging the beads of the barrel segments when the reel is assembled.

SUMMARY OF THE INVENTION

The present invention relates to a reel assembly. The reel assembly comprises a barrel having a first end and an opposing second end. Attached to each end of the barrel is a barrel head. The barrel head comprises a plate having a first face and an opposing second face. Attached to the second face are a first inner support and a second inner support. The first inner support and second inner support define a slot therebetween that is configured to receive an end of the barrel. Attached to each barrel head is also a flange. The flange has at least two flange portions releasably attached to one another.

In another embodiment, the invention is a reel assembly. The reel assembly has a barrel with a first end and an opposing second end. Two barrel heads are attached to each end of the barrel. Each barrel head is comprised of a plate having a first face and an opposing second face. The plate has an annular slot. A flange is attached to each barrel head. The flange is comprised of at least two flange portions releasably attached to one another. The barrel is attached to the barrel heads by each end of the barrel fitting snugly within the annular slot of the barrel head.

In another embodiment, the invention is a kit for forming a knockdown reel. The kit comprises a barrel having a first end and an opposing second end. It also comprises at least two barrel heads. Each barrel head comprises a plate having a first face and an opposing second face, a first inner annular support configured to be attached to the second face of the plate and a second inner annular support configured to be attached to the second face of the plate. The second inner annular support has a diameter larger than a diameter of the first inner annular support. The kit also has at least two flanges each comprising at least two flange portions configured to be attached to one another and to a portion of the barrel head.

BRIEF DESCRIPTION OF THE DRAWINGS

For purposes of illustrating the invention, the drawings show one or more forms in which the invention can be embodied. The invention is not, however, limited to the precise forms shown unless such limitations are expressly made in the claims.

DETAILED DESCRIPTION OF THE DRAWINGS

Figure 1:
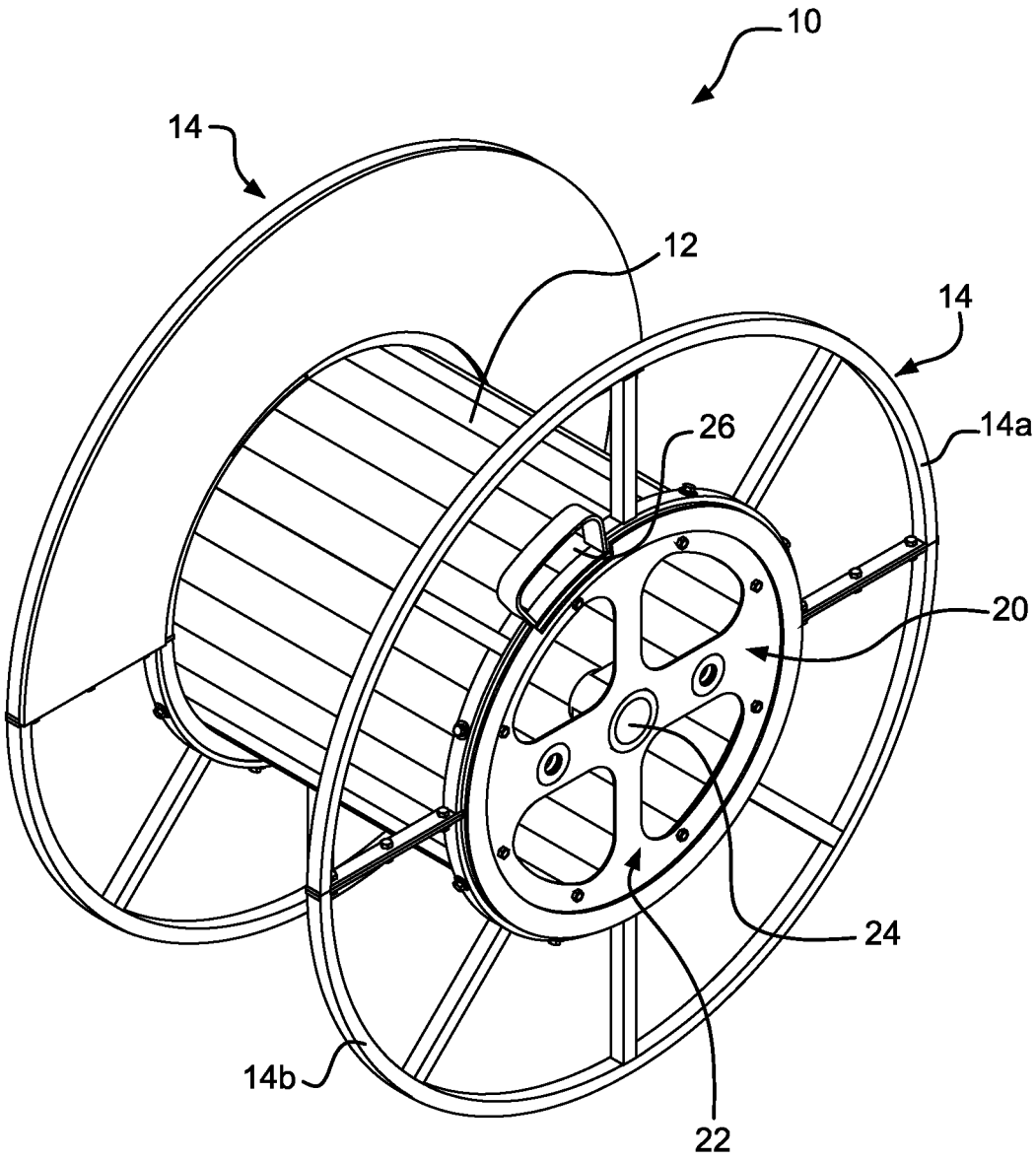
FIG. 1 is a perspective view of a first embodiment of a knockdown reel construction as contemplated by the present invention.

In the drawings, where like numerals indicate like elements, there is shown various embodiments of a knockdown or collapsible reel. The reel may store and transport wound material such as cable. The reel is preferably configured for large applications. In particular, it may be configured to receive and hold at least about 12,000 pounds of material, although lesser amounts are possible. The flanges are contemplated to be at least 96 inches in diameter. Again, small sizes are possible.

FIGS. 1-6 show a first embodiment of a collapsible reel 10. The reel is comprised of a drum or barrel 12 extending between two flanges 14. The barrel 12 has a first end and an opposing second end. The barrel shown is cylindrical, which is optimal for winding and holding cable. However, the barrel 12 may be other shapes such as a rectangular prism for other applications. The barrel 12 may be any barrel known in the art. The barrel 12 shown is made of staves or slats, which may be any material known in the art such as wood, metal, plastic, etc. The barrel 12 may also be one continuous piece, such as a rolled steel barrel. A continuous barrel may be used where the load on the barrel is anywhere from about 10 tons to about 80 tons. Individual slats may be used where the load is less.

Figure 2:
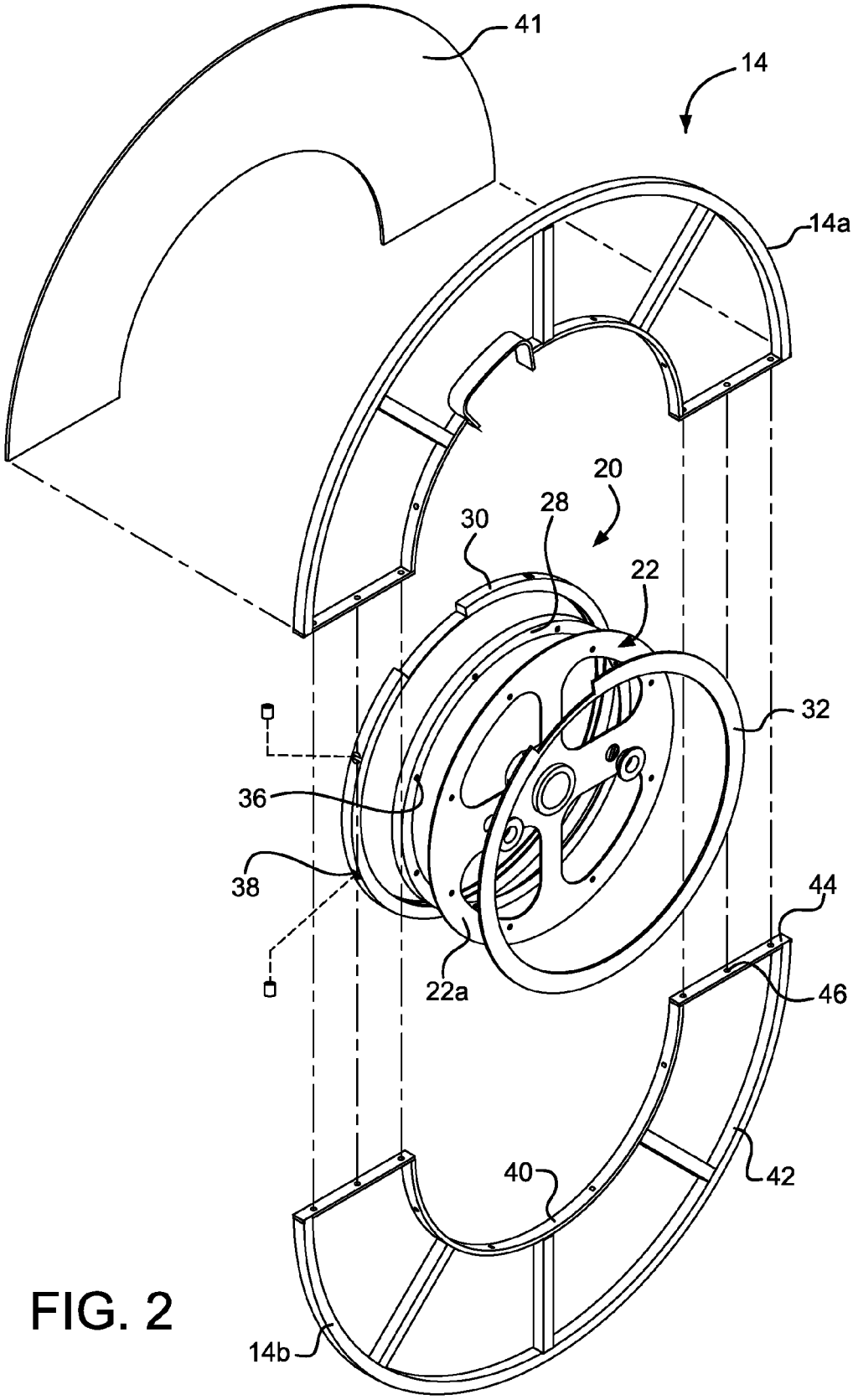
FIG. 2 is an exploded view of a barrel head and flange of the reel shown in FIG. 1.
Figure 3:
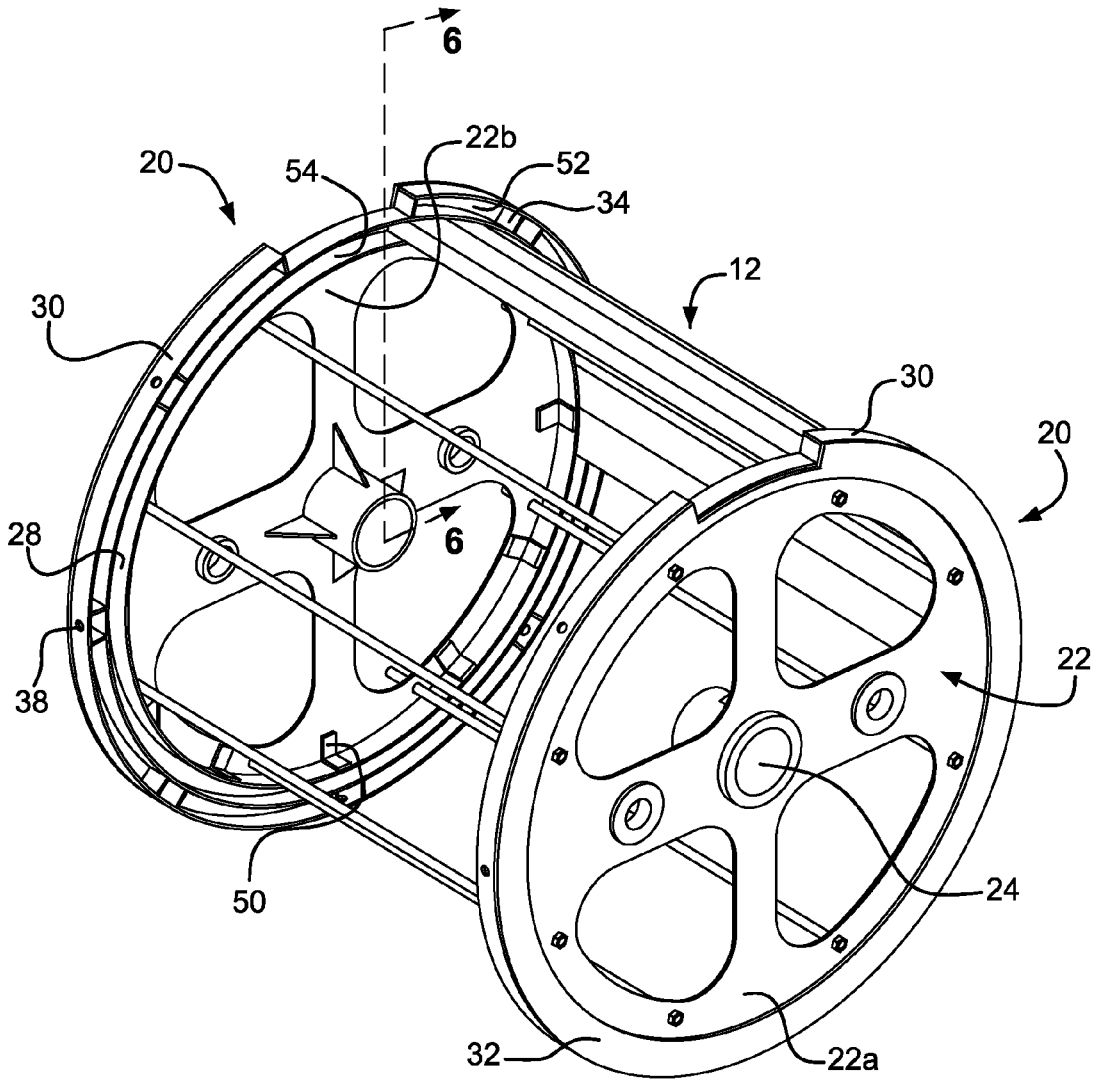
FIG. 3 is a perspective view of the barrel and barrel head portions of the reel embodiment shown in FIGS. 1 and 2 with some of the barrel removed for clarity.
Figure 4:
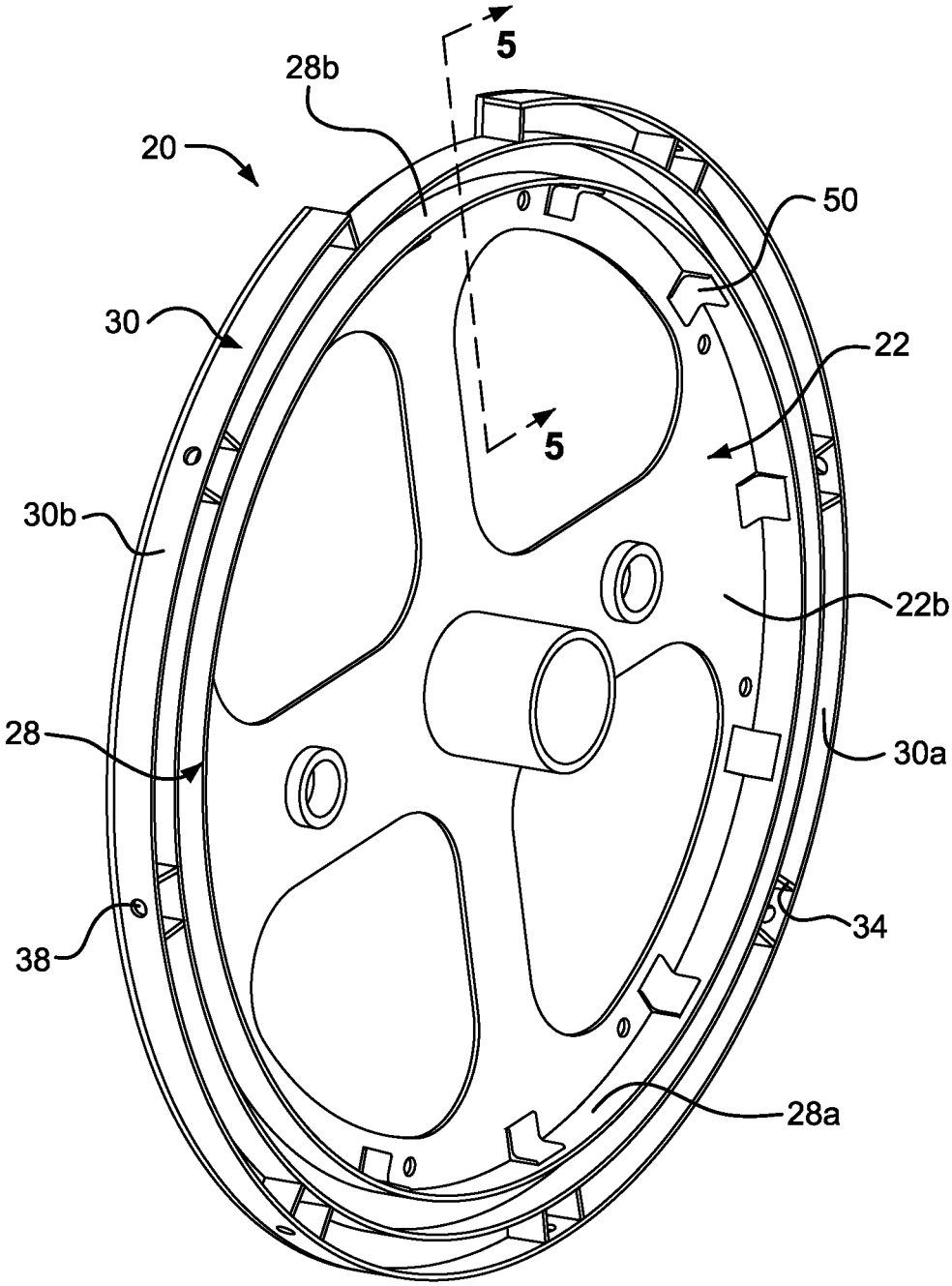
FIG. 4 shows a perspective view of the barrel head portion of the reel construction shown in FIGS. 1-3.

The reel 10 also comprises at least one barrel head 20 at the first end and at least one barrel head at the opposing second end (shown in FIGS. 3 and 4). The barrel head 20 may be bolted to the barrel 12 and to a flange 14. The barrel head 20 may have at least one plate 22 (FIG. 2). The plate 22 may have at least one bushing or passage 24 for winding operations, as known in the art. The barrel head 20 and flange 14 may also form at least one slot 26 for feeding cable to or retrieving cable from the barrel 12.

Attached to each barrel head is a flange 14. Preferably, the flange 14 is circular and has a diameter of about 1 meter to about 6 meters. When assembled, it may resemble virtually any flange known in the art. As such, it may have a tubular construction, it may be corrugated or fluted and may include structural members such as "spokes." The flange 14 may comprise at least two portions 14*a*, 14*b*, which are attached to form the flange 14. As shown in FIG. 1, these portions may be bolted together and bolted to the barrel head 20. The flange 14 and barrel heads 20 are generally perpendicular to the barrel 12.

FIG. 2 shows an exploded view of one of the barrel heads 20 and one of the flanges 14. The barrel head 20 may be comprised of at least one plate 22, at least one first inner support 28 and at least one second inner support 30. The barrel head 20 may also comprise an optional outer ring 32, attached to the second inner support 30, around the perimeter of the first face 22*a* of the plate 22. The first inner support 28 and second inner support 30 are generally circular or annular but may be other shapes. As will be shown below, the shape of the first inner support 28 and the second inner support 30 most often depends upon the shape of the barrel 12 they support.

The first inner support 28 and the second inner support 30 may have holes 36, 38, respectively, for receiving bolts, screws, etc. The second inner support 30 may also have spacers 34, which extend perpendicularly to the barrel 12, as shown in FIG. 3. These spacers 34 may house bolts or screws, which attach the barrel head 20 to a flange portion 14*a*, 14*b*. The plate 22 has a first face 22*a* facing outwardly; i.e., away from the barrel 12, and a second opposing face 22*b* facing inwardly. The first inner support 28 and second inner support 30 are attached to the second face 22*b* of the plate 22. Preferably, the first inner support 28 has a diameter smaller than that of the second inner support 30. As such, the second inner support 30 surrounds the first inner support 28, which is shown in FIG. 3. As explained below, this creates an annular second channel or slot 54 for receiving the ends of the barrel 12. As shown in more detail in FIG. 3, preferably, the difference between the diameter of the second inner support 30 and the diameter of the first inner support 28 is slightly larger than the thickness of the ends of the barrel 12. This difference in diameters forms the slot 54. Preferably, the diameter of the barrel 12 is greater than the diameter of the first inner support 28 but is less than the diameter of the second inner support 30 so that the ends of the barrel 12 fit within the slot 54.

As shown in FIG. 2, the flanges 14 are comprised of an upper portion 14*a* and a lower portion 14*b*; each having an arcuate shape. Each portion may further comprise a plate 41. Preferably, each portion 14*a*, 14*b* is a mirror image of the other portion 14*a*, 14*b* except that one portion may include the slot 26 for providing or retrieving cable. Each portion 14*a*, 14*b* may be comprised of an inner arcuate portion 40 and an outer arcuate portion 42 and have a substantially flat portion 44 connecting the inner arcuate portion 40 and the outer arcuate portion 42. The flat portion 44 may have holes 46 or other means for receiving attaching means such as bolts, screws, etc. It will be understood that the flange portions 14*a*, 14*b* may be attached to each other via other means as long as these means allow for quick detachment of the flange portions 14*a*, 14*b* from each other.

When the upper portion 14*a* and lower portion 14*b* are attached along their respective flat portions 46, they form the circular flange shown in FIG. 1. The inner arcuate portions 40 form a circular opening for housing the barrel head 20 and the outer arcuate portions 42 form a circular rolling surface. The portions may be made of virtually any material known in the art. The inner arcuate portions 40 may also have means for attaching at least one of the portions 14*a*, 14*b* to the barrel head 20. In the embodiment shown in FIGS. 1-6, the upper portion 14*a* is attached; for example via bolts, to the barrel head 20 and the lower portion 14*b*, which is also attached to the barrel head 20. In particular, the upper portion 14*a* and lower portion 14*b* are attached to the barrel head 20 by being bolted or screwed into the second inner support member 14*b*, via holes 38; shown in FIGS. 2 and 3. It will be understood that the flanges 14 may be attached to the barrel head 20 via other means, as long as these means allow for quick detachment of the flange portions 14*a*, 14*b* from the barrel head.

FIG. 3 shows two barrel heads 20 attached to opposing ends of the barrel 12, with portions of the barrel removed for clarity. As provided above, the plates 22 have a first face 22*a* and a second face 22*b*. The first inner support 28 is attached to the second face 22*b* of the plate 22. The first inner support 28 may be attached to the second face 22*b* of the plate by virtually any means. As shown in FIGS. 3 and 4, the first inner support 28 is attached to the second face 22*b* by angle irons or tabs 50. The tabs 50 may be welded to the first inner support 28 and the second face 22*b*. The first inner support 28 may also be attached to the plate 22 by bolts.

The second inner support 30 is also attached to the second face 22*b* of the plate 22. The second inner support 30 may be attached to the second face 22*b* of the plate 22 by virtually any means. As shown in FIG. 3, the second inner support 30 is attached to the plate 22 by bolts. When the outer ring 32 is used, the second inner support 30 may also be attached to the outer ring 32. The second inner support 30 has an inner surface 30*a* and an outer surface 30*b* that are spaced to form a first channel 52. The outer surface 30*b* may have slots or holes 38 for receiving means for attaching the flange portions 14*a*, 14*b*, such as bolts or screws. The first channel 52 also may include spacers 34. The first channel 52 may house the bolts or screws used to attach the flange portions 14*a*, 14*b* to the barrel head 20. In particular, these bolts may be received between spacers 34.

As shown in FIGS. 3 and 4, the inner diameter of the second inner support 30 is larger than the outer diameter of the first inner support 28. As such, the second inner support 30 surrounds the first inner support 28, preferably, such that there is a space between the inner surface 30*a* of the second inner support member 30 and the outer surface 28*b* of the first inner support member 28 (shown in FIG. 4). In particular, the inner and outer annular supports are radially aligned. In addition, the first inner support 28 and the second inner support 30 have a thickness that extends from the second face 22*b* of the plate 22 toward the barrel 12. The space between the first inner support 28 and the second inner support 30 as well as the thickness of these members 28, 30 creates a second channel or annular slot 54 for receiving the ends of the barrel 12. As shown in FIG. 3, the ends 16 of barrel slats are positioned in the slot 54. Preferably, the shape of the ends of the barrel conforms to the arcuate shape of the slot 54. The ends of the barrel are supported by the outer surface 28*b* of the first inner support member 28. In particular, the ends of the barrel 12 may fit within the slot 54 snugly and, thus, be held by friction.

Figure 5:
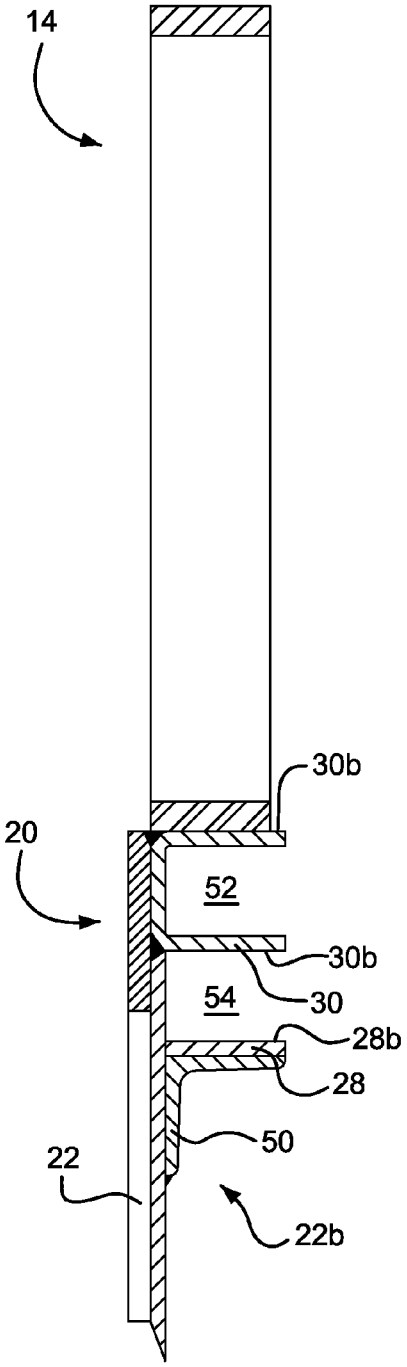
FIG. 5 shows a partial cross-sectional view of the barrel head of FIG. 4 with a flange attached.
Figure 6:
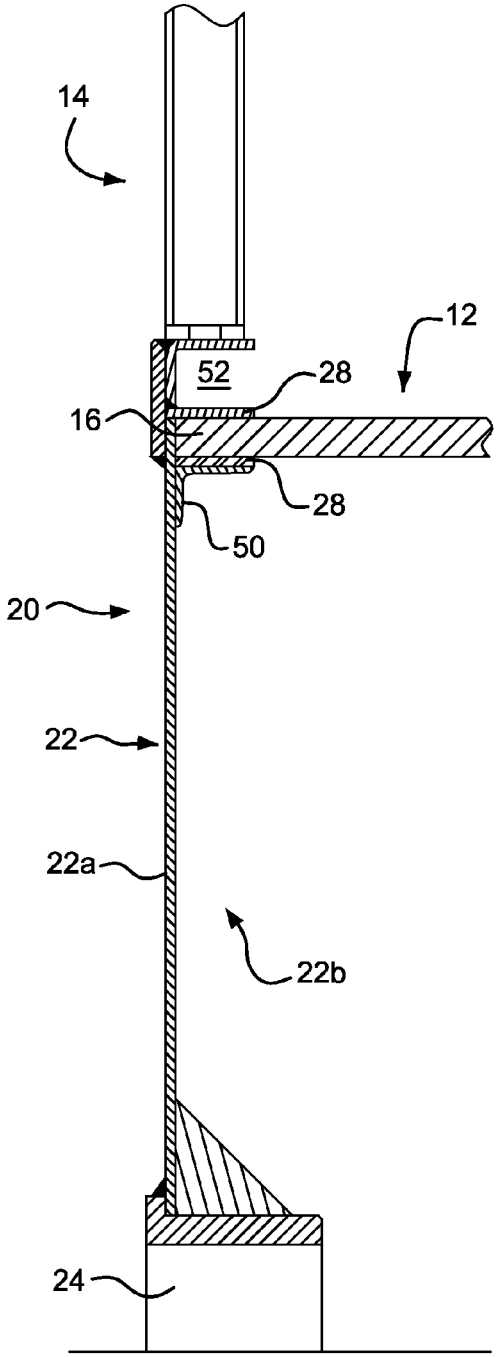
FIG. 6 is a partial cross section of a barrel head portion of FIG. 3 with a flange attached.

The first channel 52 and second channel 54 are also shown in FIGS. 5 and 6. As shown in FIG. 6, a barrel slat or portion of the barrel 12 fits snugly within the second channel or slot 54, which is created by the first inner support 28 and the inner surface 30*a* of the second inner support 30. As shown in FIGS. 5 and 6, the outer surface 30*b* of the second inner support 30 is in contact with the upper portion 14*a* of the flange 14.

Figure 7:
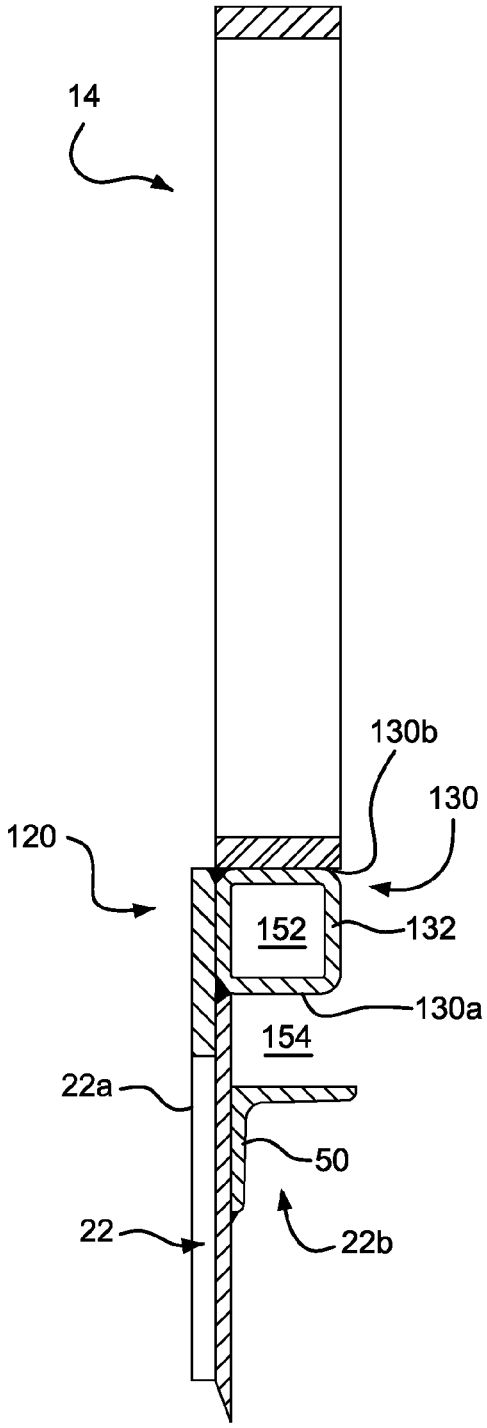
FIG. 7 is a partial cross-sectional view of an alternate embodiment of a barrel head portion as contemplated for use with a reel construction of the present invention with a flange attached.
Figure 8:
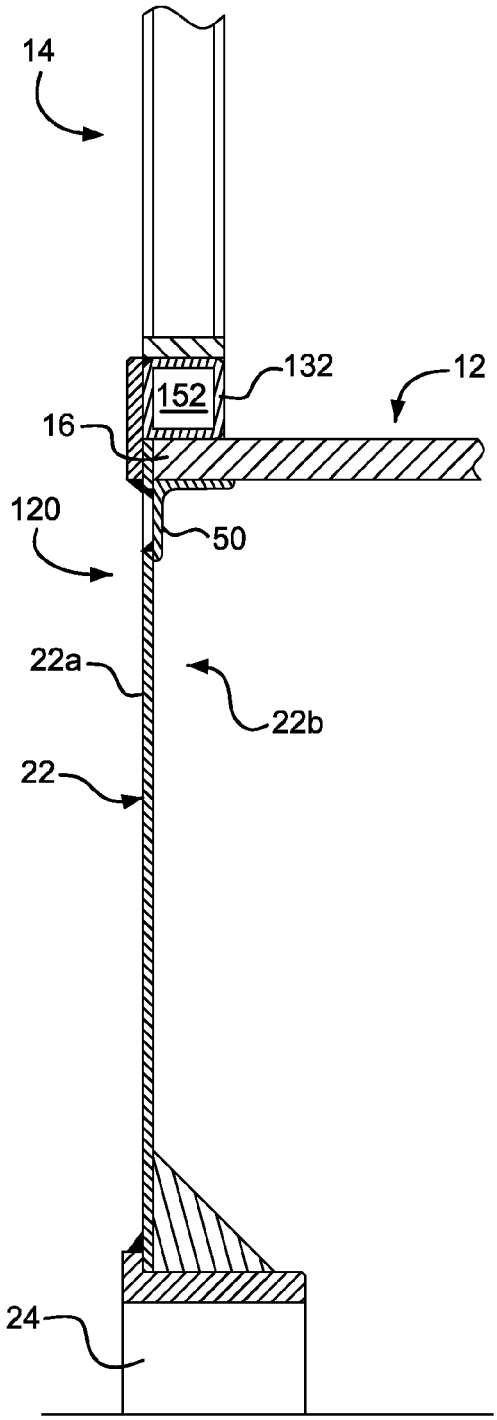
FIG. 8 is a further partial cross-sectional view of the embodiment of the barrel head portion as shown in FIG. 7 with a flange attached and a portion of a barrel.
Figure 9:
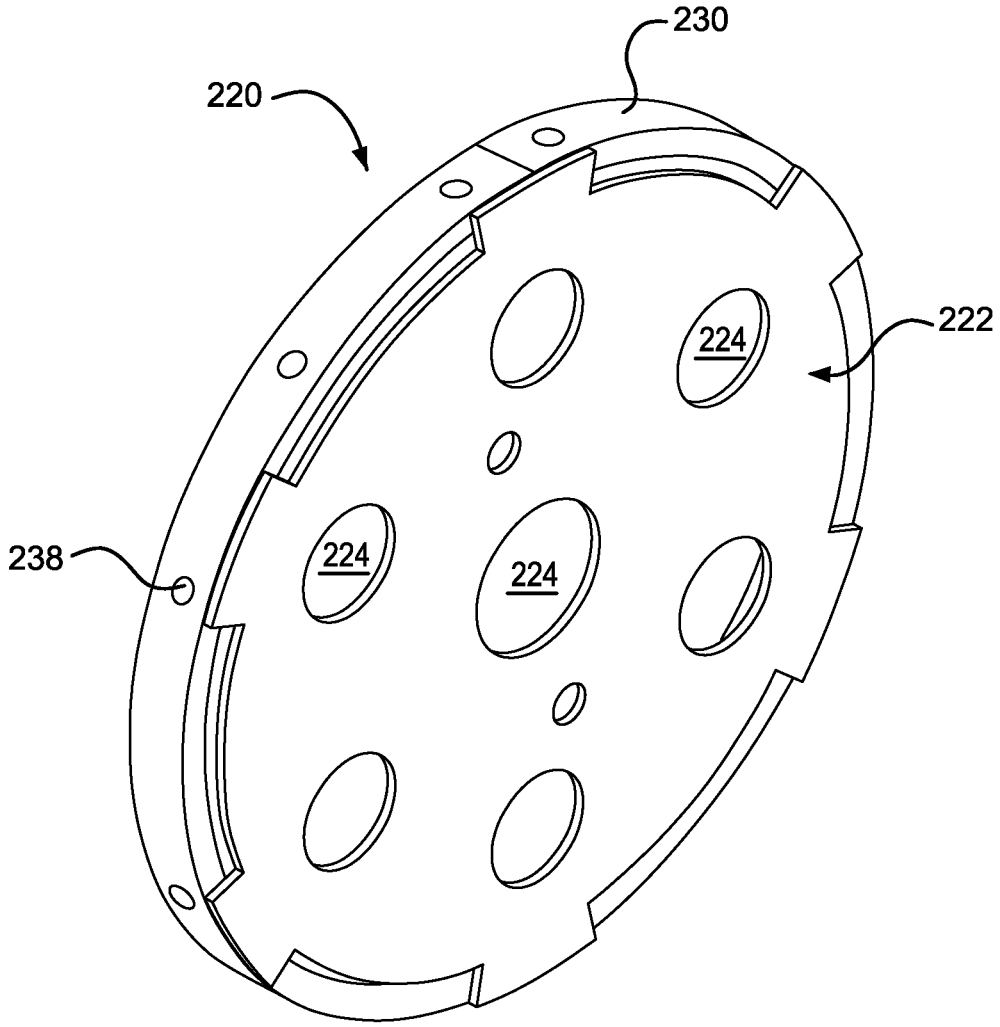
FIG. 9 is a perspective view of another embodiment of the barrel head assembly according to the present invention.

FIGS. 7 and 8 show a second embodiment of a barrel head 120 attached to a flange 14. This barrel head 120 has the same general structure as the one shown in FIGS. 1-6 and may be used with the barrels 12 and the flange portions 14*a*, 14*b* shown in FIGS. 1-6.

Preferably, the barrel head 120 of the second embodiment comprises the plate 22, a modified generally circular second inner support 130 and possibly, the outer ring. However, in the embodiment shown in FIGS. 7 and 8, the second inner support member 130 comprises a vertical portion 132 between the inner surface 130*a* and the outer surface 130*b* of the second inner support 130. As such, the modified first channel 152 is not open as in the embodiment shown in FIGS. 3-6. Nevertheless, this first channel 152 serves the same function as the first channel 52 shown in the embodiment of FIGS. 3-6; namely, it provides a housing for a means for attaching the portions of the flange 14*a*, 14*b* to the barrel head 120. In addition, in the embodiment shown in FIGS. 7 and 8, there may be no first inner support. Rather, the barrel head may have tabs 50 for supporting the barrel or barrel slats. The space between the tab and the inner surface of the second inner support create the modified second channel 154. Similar to the embodiment shown in FIGS. 3-6, a portion of the barrel 12; for example a slat, fits snugly within the second channel 154.

In the embodiments shown in FIGS. 1-8, the second channel or slot 54, 154 is created by the first inner support 28 or tab 50 and the second inner support 30, 130. In other embodiments (not shown), the slot may be formed without these supports. In particular, the slot may be formed as part of or formed within the second face of plate. In these embodiments, the barrel head may comprise only the plate. For example, the plate may have a thickness and a slot channeled therein. The plate may also have an annular support molded therewith; i.e., not as a separate component. The plate may also have a thickness at its perimeter providing a surface and means for attaching the flange portions.

FIGS. 9-12 show a third embodiment of a barrel head 220. As described below, this third embodiment is configured to attach to the flanges 14 shown in FIG. 1. The barrel head 220 has a plate 222, which has a slightly different configuration than that shown in FIG. 1. In particular, the plate 222 may have bushings or holes 224 in a circular pattern around a central bushing. It also may have smaller holes for different winding operations. It will be understood that the embodiments of the invention may use different plates for different applications such as different cable winding operations.

Figure 11:
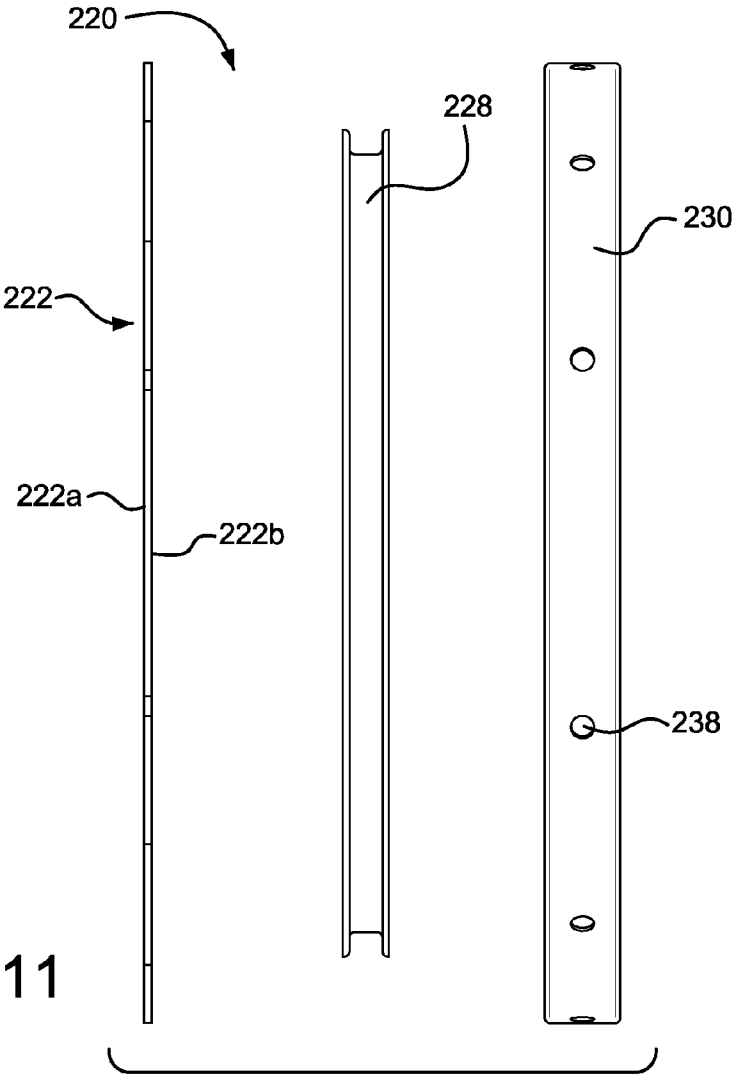
FIG. 11 is an exploded view of the barrel head assembly as illustrated in FIG. 10.

As shown in FIG. 11, this barrel head 220 is also comprised of a generally circular first inner support 228 and a generally circular second inner support 230, each attached to the second face 222*b* of the plate 222. The first inner support 228 has a smaller diameter than that of the second inner support 230. As such, the first inner support 228 is surrounded by the second inner support 230. The plate 222 attaches to the second inner support 228 around the perimeter of the second inner support 230.

The second inner support 230 may have an inner surface and an outer surface that are spaced to form a first channel 252, which may be closed like the first channel 152 shown in FIGS. 7 and 8. The second inner support 230 has an outer surface 230*b* with holes 238, which are configured to receiving means for attaching the flange portions 14*a*, 14*b* (FIG. 2). As described above with respect to the embodiments shown in FIGS. 1-8, the closed first channel 252 may house a bolt or screw used to attach flange portions.

Figure 10:
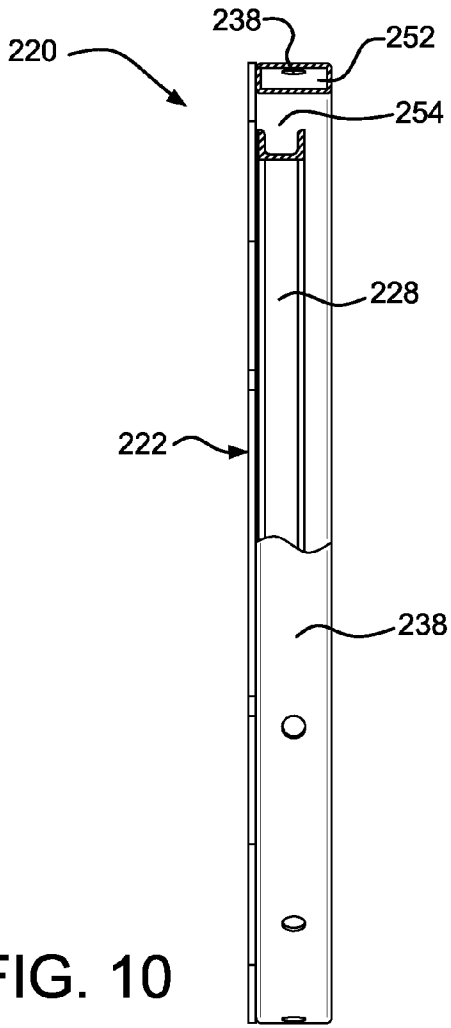
FIG. 10 is a partial cross section of the barrel head assembly shown in FIG. 9.

As in the embodiments shown in FIGS. 1-8, the first inner support 228 has an outer surface configured to support the ends of the barrel or barrel slats. As shown in FIG. 10, the diameter of the first inner support 228 is such that there is a space 254 between the outer surface of the second inner support 230 and the first inner support 228. The end of the barrel or ends of the slats (not shown) may fit within the space 254 between the outer surface of the first inner support 228 and the inner surface of the second inner support 230.

Figure 12:
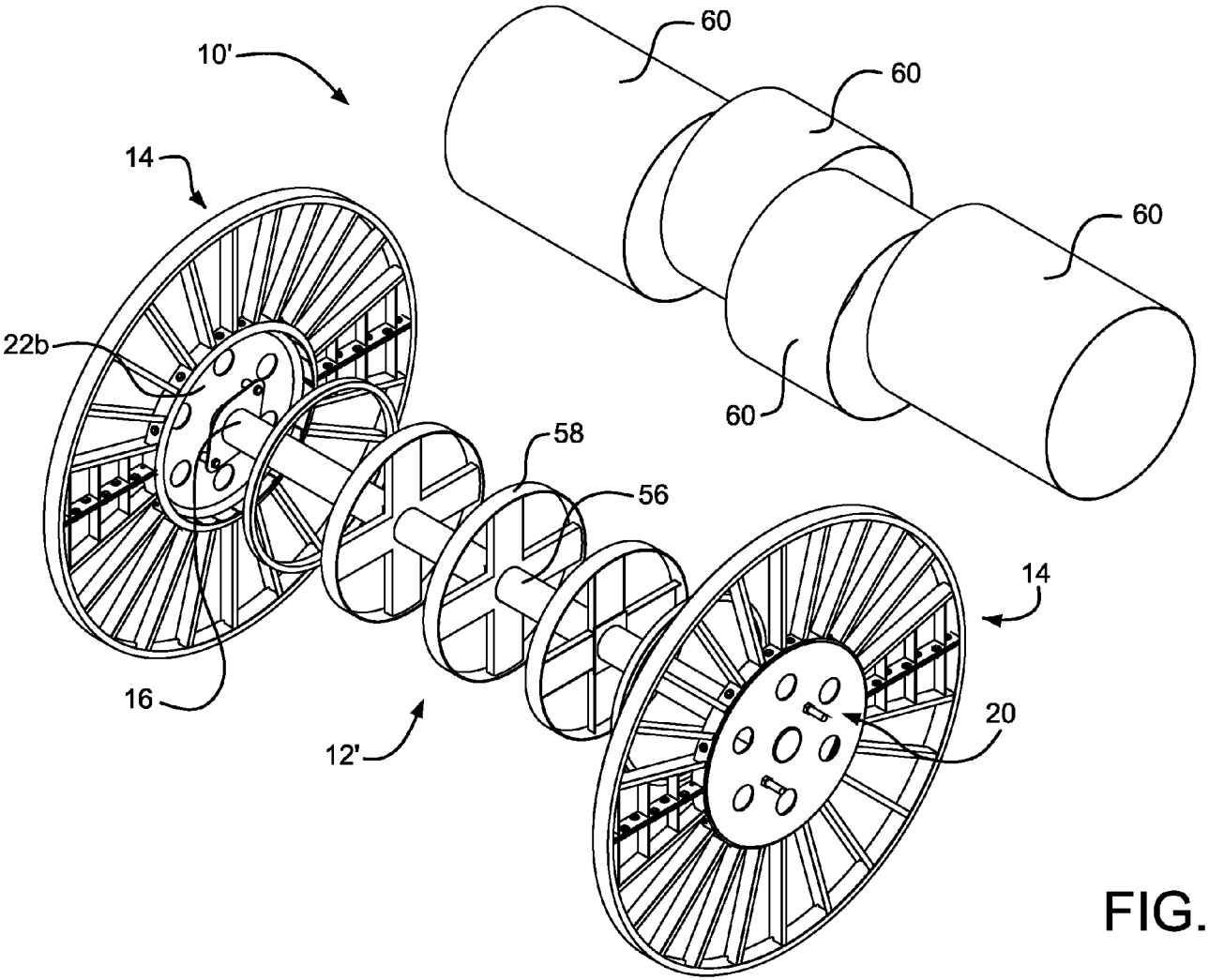
FIG. 12 is an alternate reel construction showing moldable barrel portions and internal barrel support members.

As provided above, the barrel head 20, 120, 220 and flange assemblies 14 shown in the Figures and described above can be used with virtually any barrel. The barrel may be made of arcuate staves or slats, which may be any material known in the art such as wood, metal, plastic, etc. The barrel may also be one continuous piece, such as a rolled steel barrel. FIG. 12 shows a knockdown reel having a collapsible barrel 12'. The barrel 12' has a longitudinally-extending central member 56 surrounded by supports 58, which are spaced along the length of the central member 56. The central member 56 extends between barrel heads 20, 120, 220, attached to a flange 14. The barrel heads 20, 120, 220 may be any of those shown in the Figures and described above. The flanges 14 may be comprised of an upper flange portion and a lower flange portion and attached to the barrel head as described above. The central member 56 may be attached to the plate of the barrel head by bolts, screws, etc.

The supports 58 and central member 56 support at least one barrel outer shell 60. As shown in FIG. 12, the barrel may comprise four barrel shell segments. The segments snugly surround the supports 58 and are disposed in a line along the length of the central member 56. Preferably, the ends of the shell segments fit within at least one channel formed on or in the second face of the plate. This channel may be the second channels 54, 154 described above.

The embodiments of the reel shown in the Figures and described above are all easily collapsible or "knockdown."

Figure 13:
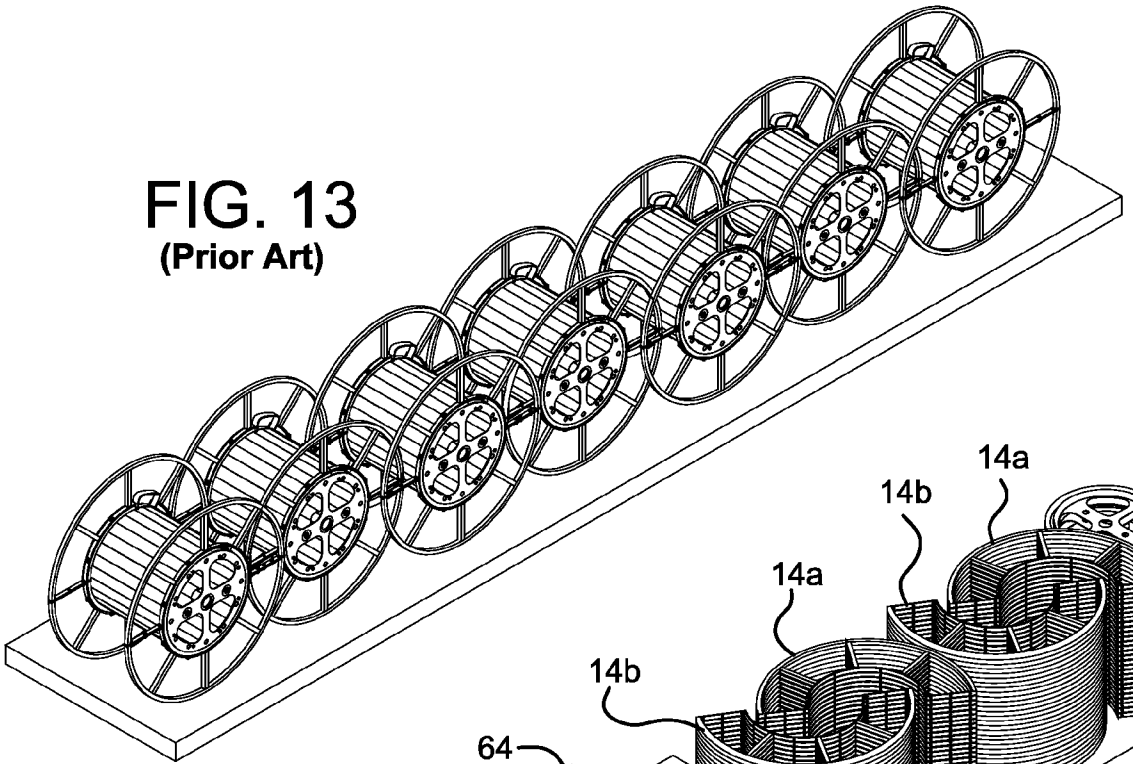
FIG. 13 (Prior Art)
FIG. 13 is a perspective view of a shipping arrangement of reel assemblies in the fully constructed position.
Figure 14:
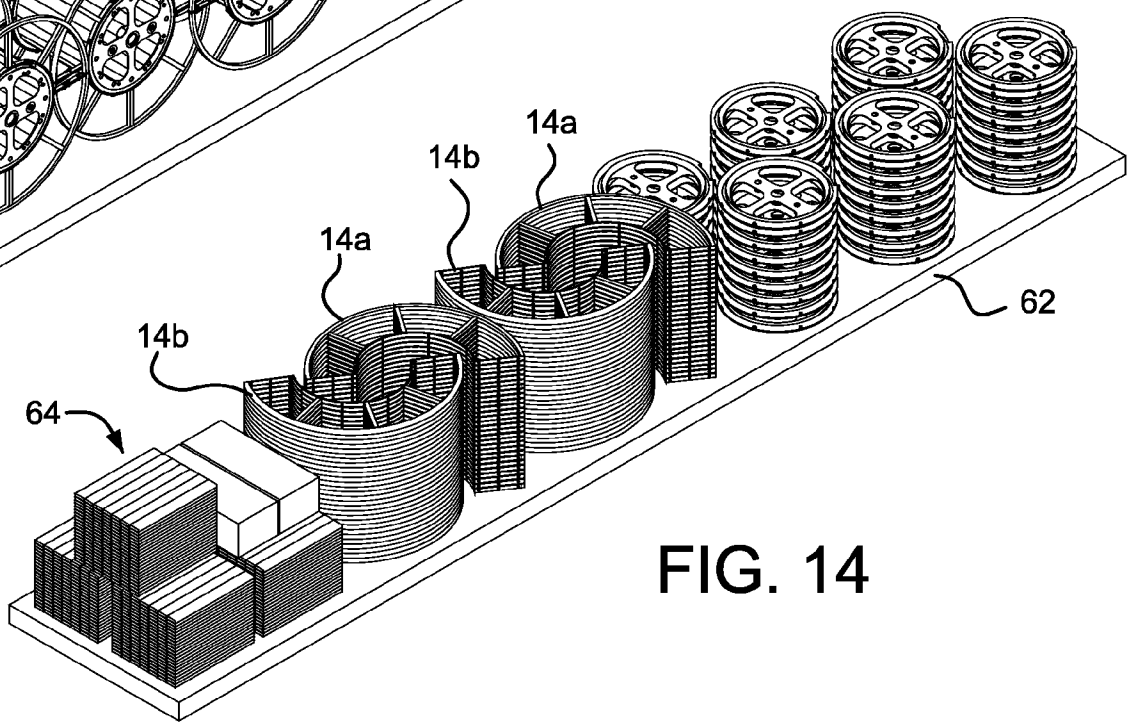
FIG. 14 is a perspective view of a shipping arrangement of multiple reel assemblies in the knockdown condition.

With reference to FIGS. 1-4, to dissemble the reel, a user may first separate the first flange portion 14*a* from the second flange portion 14*b*. This may be done by removing the bolts or screws. The barrel heads 20 may then be removed by simply pulling or sliding the ends of the barrel 12 or ends of the barrel slats out from the snug hold of the second channel 54. If the ends of the barrel or barrel slats are further attached in the second channel 54 by other attaching means such as screws or bolts, these may also be removed. The user is now left with the upper portion 14*a* of the flange 14, the lower portion 14*b* of the flange 14, two barrel heads 20 and a barrel 12 or a plurality of barrel slats 64. As shown in FIG. 14, all of these components are easily stacked or arranged for compact transport on a flat bed 62. This is a vast improvement over the transport arrangement of known reels; shown in FIG. 13, which cannot be easily broken down or cannot be broken down at all. As shown in FIG. 13, only about seven reels can fit on the transport bed. As shown in FIG. 14, many more "reels", when separated into component parts, can fit on the same transport bed.

The barrel 12' of the knockdown reel shown in FIG. 12 may be further collapsed thus providing for even more compact storage and transportation. The flanges are removed from the barrel heads as described above. The barrel heads are removed by detaching the central member from the plates. The barrel may then be further collapsed. In particular, the barrel shell pieces may be removed from the supports. The supports may then be detached from the central member. As such, the barrel breaks down into a plurality of components that may be easily stacked for compact transportation and storage.

The present invention may be embodied in other specific forms without departing from the spirit and central attributes. Accordingly, reference should be made to the appended claims rather than the foregoing specification as indicating the scope of the invention.

What is claimed is:

1. A reel assembly comprising:

a barrel having a first end and an opposing second end;

a barrel head attached to each of the first and second ends of the barrel, the barrel heads comprising a planar plate having a first face and an opposing second face, a first inner support projecting from the second face, and a second inner support projecting from the second face, the first inner support and second inner support defining an open slot there between configured to receive an end of the barrel, and a channel formed between an inner surface of the second inner support and an outer surface of the second inner support; and a flange attached to each barrel head, the flange comprised of at least two flange portions releasably attached to one another, wherein the flange portions are attached to the outer surface of the second inner support.

2. The reel assembly of claim 1, wherein the first inner support and the second inner support are spaced radially with respect to one another.

3. The reel assembly of claim 1, wherein the slot is configured to frictionally retain the end of the barrel.

4. The reel assembly of claim 1, further comprising an outer ring attached to the first face of the plate, and wherein the second inner support is attached to the outer ring.

5. The reel assembly of claim 1, wherein the barrel is configured to receive and transport loads of at least about 12,000 pounds.

6. The reel assembly of claim 1, wherein flanges are at least about 96 inches in diameter.

7. The reel assembly of claim 1, wherein the channel formed between the inner surface and the outer surface is open and directed transverse to the second face of the plate.

8. A kit for forming a knockdown reel, the kit comprising:

a substantially hollow barrel having a first end and an opposing second end;

at least two substantially planar barrel heads each comprising:

a plate having a first face and an opposing second face;

a first inner annular support configured to be attached to the second face of the plate;

a second inner annular support attached to the second face of the plate, the second inner annular support having a diameter larger than a diameter of the first inner annular support, the first and second inner annular supports being radially aligned and defining a slot there between, the slot directed transverse to the second face of the plate and spaced for receiving one end of the barrel therein, and a channel formed by the second inner support, the channel formed outwardly of the slot between an inner surface and an outer surface of the second inner support; and at least two flanges each comprising at least two flange portions configured to be attached to one another, the flange portions configured to be attached to an outer periphery of the barrel head as defined by the outer surface of the second inner annular support.

9. The kit of claim 8, wherein a difference between the diameter of the second inner annular support and the diameter of the first inner annular support is formed to frictionally receive the end of the barrel.

10. The kit of claim 8, wherein the diameter of the barrel is larger than the diameter of the first inner annular support but is smaller than the diameter of the second inner annular support.

11. The kit of claim 8, wherein the barrel heads further comprise at least one outer ring configured to be attached to the second inner annular support.

12. The kit of claim 8, wherein the barrel is comprised of a plurality of longitudinally-extending slats.

13. The kit of claim 8, wherein the flanges are comprised of an upper portion and a lower portion, each upper portion and each lower portion having an inner arcuate portion and an outer arcuate portion and a substantially flat portion connecting the inner arcuate portion and the outer arcuate portion, wherein the substantially flat portion comprises means for attaching the upper portion to the lower portion.

14. A reel assembly comprising:

a barrel having a first end and an opposing second end;

two barrel heads each comprising a plate having a first face and an opposing second face, the second face comprising an annular slot, and a channel formed adjacent to and outwardly of the slot; and a flange attached to each barrel head, each flange comprised of at least two flange portions releasably attached to one another, wherein each end of the barrel is attached to a corresponding one of the first or second barrel heads, with the barrel end being retained within the annular slot of the corresponding barrel head, and wherein the flange portions of each flange are releasably attached to the channel of the corresponding barrel head and are spaced radially outwardly of the end of the barrel retained within the adjacent slot.

15. The reel assembly of claim 14, wherein the flanges are attached to only the barrel head.

16. The reel assembly of claim 15, wherein the channel comprises an outer surface radially spaced from the annular slot, and wherein the flange portions are releasably attached to the outer surface.

17. The reel assembly of claim 14, wherein the barrel comprises a longitudinally-extending central member surrounded by supports and a plurality of segments configured to fit around the supports.

* * * * *